US006762687B2

(12) United States Patent
Perlman

(10) Patent No.: US 6,762,687 B2
(45) Date of Patent: Jul. 13, 2004

(54) BIOFEEDBACK DEVICE FOR TREATING OBSESSIVE COMPULSIVE SPECTRUM DISORDERS (OCSDS)

(76) Inventor: David Perlman, 1039 Olivia, Ann Arbor, MI (US) 48104

( * ) Notice: Subject to any disclaimer, the term of this patent is extended or adjusted under 35 U.S.C. 154(b) by 95 days.

(21) Appl. No.: 10/175,934

(22) Filed: Jun. 20, 2002

(65) Prior Publication Data

US 2003/0234727 A1 Dec. 25, 2003

(51) Int. Cl.[7] ..... G08B 23/00
(52) U.S. Cl. ..... 340/573.1; 607/45; 607/58
(58) Field of Search ..... 340/573.1, 539.11, 340/539.12; 607/58, 45, 60, 62, 63; 434/1; 446/27; 473/8

(56) References Cited

U.S. PATENT DOCUMENTS

| | | | | | |
|---|---|---|---|---|---|
| 1,772,601 | A | | 8/1930 | Dunham | 128/881 |
| 3,889,163 | A | * | 6/1975 | Symmes | 607/58 |
| 4,189,712 | A | * | 2/1980 | Lemelson | 340/542 |
| 4,440,160 | A | | 4/1984 | Fischell et al. | 128/846 |
| 4,524,773 | A | | 6/1985 | Fischell et al. | 607/58 |
| 4,682,155 | A | * | 7/1987 | Shirley | 340/573.4 |
| 4,684,933 | A | * | 8/1987 | Dill | 340/573.4 |
| 4,692,748 | A | * | 9/1987 | Pinsak et al. | 340/573.1 |
| 4,715,367 | A | | 12/1987 | Crossley | 600/27 |
| 4,842,519 | A | * | 6/1989 | Dworkin | 433/215 |
| 4,965,553 | A | | 10/1990 | DelBiondo, II et al. | 340/573.1 |
| 5,123,425 | A | | 6/1992 | Shannon, Jr. et al. | 128/848 |
| 5,218,344 | A | * | 6/1993 | Ricketts | 340/573.4 |
| 5,396,215 | A | * | 3/1995 | Hinkle | 340/426.17 |
| 5,477,867 | A | | 12/1995 | Balkanyi | 128/848 |
| 5,978,972 | A | | 11/1999 | Stewart et al. | 2/422 |
| 6,093,158 | A | | 7/2000 | Morris | 600/590 |
| 6,334,073 | B1 | | 12/2001 | Levine | 607/58 |
| 6,567,785 | B2 | * | 5/2003 | Clendenon | 705/11 |
| 2002/0013612 | A1 | * | 1/2002 | Whitehurst | 607/45 |

* cited by examiner

*Primary Examiner*—Thomas J Mullen, Jr.
(74) *Attorney, Agent, or Firm*—Gilford, Krass, Groh, Sprinkle, Anderson & Citkowski, PC

(57) ABSTRACT

A biofeedback device for treatment of certain obsessive compulsive spectrum and habit disorders including trichotillomania (hair pulling), onychophagia (nail biting), thumb-sucking, skin-scratching (dermatillomania) and certain other self-inflicted harm, includes a sensing element and triggering device, both worn on various parts of the body, depending upon the particular characteristics of an individual's disorder. The biofeedback device is able to sense the movement of one body part relative to another and set off an alarm mechanism prior to contact, assisting the patient in avoiding the destructive behavior.

19 Claims, 1 Drawing Sheet

BIOFEEDBACK DEVICE FOR TREATING OBSESSIVE COMPULSIVE SPECTRUM DISORDERS (OCSDS)

FIELD OF THE INVENTION

The present invention relates generally to apparatus for persons suffering from obsessive compulsive spectrum disorders (OCSDs) or habit disorders and, more particularly, to a biofeedback device and associated methods of use which anticipate an impending movement of one body part towards another as being indicative of undesirable behavior typical of such disorders.

BACKGROUND OF THE INVENTION

Obsessive compulsive spectrum disorders (OCSDs) are potentially disabling conditions that can persist throughout a person's life. These include impulse control disorders typified by a failure to control physical impulses that are generally harmful towards self or others, including trichotillomania (hair pulling), onychophagia (nail biting), skin picking (dermatillomania), gambling and kleptomania. This invention is particularly concerned with OCSDs that are of a physically self injurious nature, such as hair pulling, skin picking, and nail biting, as well as the treatment of obsessive compulsive disorders that involve physical rituals, such as hand washing.

For many years, mental health professionals thought of OCSDs as rare diseases because only a small minority of their patients had the condition. These disorders often went unrecognized because many of those afflicted, in efforts to hide their unusual and sometimes embarrassing behaviors, declined to seek treatment. This led to underestimates in the number of people with these disorders. However, a survey conducted in the early 1980s by the National Institute of Mental Health (NIMH) showed that OCSDs affect more than 2 percent of the population, meaning that these afflictions are more common than mental illnesses such as schizophrenia, bipolar disorder, or panic disorder. OCSDs strike people of all ethnic groups. Males and females are equally affected. The social and economic costs of OCSDs are measured in billions of dollars.

The most classic OCSDs are true obsessive compulsive disorders. In this case, obsessions are unwanted ideas or repetitive impulses such as persistent fears that harm may come to one's self or a loved one, an unreasonable concern with becoming contaminated, or an excessive need to do things correctly or perfectly. Again and again, the individual experiences disturbing and sometimes bizarre thoughts, such as, "My hands may be contaminated—I must wash them"; "I may have left the gas on"; or "I am going to injure my child." Obsessional thoughts may be violent or sexual in nature, or hypochondriacal—among people who are not predisposed towards abnormal violent or sexual behavior, and have no history of serious illness. Such thoughts are intrusive, unpleasant, and produce a high degree of anxiety—to the extent that they disrupt normal daily functioning.

In response to these obsessional thoughts, most people with OCSDs develop repetitive behaviors called compulsions. The most common of these are washing and checking. Other compulsive behaviors include counting (often while performing another compulsive action such as hand washing), repeating, hoarding, and endlessly rearranging objects in an effort to keep them in precise alignment with each other. Mental problems, such as mentally repeating phrases, list-making, or checking are also common. These behaviors serve the immediate function of temporarily reducing the anxiety associated with the obsession or irrational thought. While such behaviors as hair pulling and skin picking are not ritualized, they also function to reduce irrational anxiety. In this way the behavior reinforces itself—the more gratifying the behavior (no matter how strange) the more likely it will recur. As with the obsessional thoughts, the ritualized behaviors are also themselves very disruptive to daily functioning.

For most people with OCSDs, the urge to engage in the behavior after the anxiety producing thought is so powerful that it is almost impossible to function until this occurs. For example people with washing rituals may have to interrupt their activities 50 or 60 times a day to wash their hands, and often develop skin infections as a result of excessive drying and chapping of the skin. Some behaviors, such as skin picking and hair pulling, may be less disruptive in the moment, but may lead to social and physical consequences (baldness, abdominal infections, septic skin infections, and scarring) as disruptive as any other OCSD.

Although OCSD symptoms typically begin during the teenage years or early adulthood, recent research shows that some children develop the illness at earlier ages, even during the preschool years. Studies indicate that at least one-third of OCSDs in adults began in childhood. Suffering from OCSDs during early stages of a child's development can cause severe problems for the child. It is important that the child receive evaluation and treatment by a knowledgeable clinician to prevent the child from missing important opportunities because of this disorder. OCSDs, while somewhat amenable to treatment, are notoriously difficult to truly eradicate in clinical practice. Clinical and animal research sponsored by NIMH and other scientific organizations has provided information leading to both pharmacologic and behavioral treatments that can benefit the person with OCSDs, but what is certain is that there is no one cure, and that multiple approaches are a must in treating this difficult and emotionally painful disease. One patient may benefit significantly from behavior therapy, while another will benefit from pharmacotherapy. Some others may use both medication and behavior therapy. Others may begin with medication to gain control over their symptoms and then continue with behavior therapy. Which therapy to use should be decided by the individual patient in consultation with his or her therapist.

Traditional psychotherapy, aimed at helping the patient develop insight into his or her problem, is generally not helpful for OCSDs. Sufferers of OCSDs are typically well-aware of the oddity of their thoughts and behaviors, and this awareness in fact may contribute to their sense of distress. However, studies of behavior therapy for OCSDs have found this to be a successful approach for the majority of patients who are able to complete treatment. Furthermore, the positive effects of behavior therapy typically endure once treatment has ended. The most common behavioral approach is known as 'exposure with response prevention'—which consists of exposing or allowing the OCSD sufferer to experience the anxiety or obsessional thoughts, while preventing the ritual or anxiety reducing behaviors. While this sounds simple, it is actually quite an aversive process for the average OCSD sufferer. But, it does work. A recent compilation of outcome studies indicated that, of more than 300 OCSD patients who were treated by exposure and response prevention, an average of 76 percent still showed clinically significant relief from 3 months to 6 years after treatment (Foa & Kozak, 1996). Another study has found that incorporating relapse-prevention components in the treatment program, including follow-up sessions after the intensive therapy, contributes to the maintenance of improvement (Hiss, Foa, and Kozak, 1994).

One study provides new evidence that cognitive-behavioral therapy may also prove effective for OCSDs. This variant of behavior therapy emphasizes changing the OCSD sufferer's beliefs and thinking patterns. Additional studies are required before the promise of cognitive-behavioral therapy can be adequately evaluated. The ongoing search for causes, together with research on treatment, promises to yield even more hope for people with OCSD and their families.

Certain OCSDs, including trichotillomania (hair pulling), onychophagia (nail biting), thumb sucking, skin scratching (dermatillomania), and so forth, involve self-inflicted harm. There are a number of products available to help alleviate the discomfort and distress associated with such conditions, these being primarily certain drugs and physical impediment devices such as special gloves. These articles, while occasionally satisfactory for their intended purpose, are helpful in only a small number of cases.

The use of physical restraints is quite old, and various patents exist which are directed to such apparatus. U.S. Pat. No. 1,772,601, which issued in 1930, resides in a thumb-sucking preventor, which consists generally in a pair of sleeves, one of which is attached to the arm above the elbow and the other below the elbow. Connecting the sleeves there is a pivotal joint which is positioned substantially in line with the axis of the elbow joint, so that bending movement of the arm, simulating a hinge in its action, is imparted to the pivotal connection between the sleeves. Associated with the pivotal connection is a stop which limits the swinging or hinge-like movement of the arm toward the head, thereby enabling the infant to move its arm in a free and natural way up to a certain point where further movement is prevented so that the thumb cannot be placed in the mouth without assuming a forced and somewhat cramped or uncomfortable position.

Over the years, more sophisticated approaches have evolved, in most cases switching from mechanical solutions. U.S. Pat. No. 6,093,158, for example, is directed to a system for monitoring an undesired behavioral disorder such as bruxism, jaw clenching, or snoring. A processor correlates the monitored behavior with the onset of the undesired disorder. Since behavior of this type is typically subconscious, the sensor is preferably coupled to a warning device to alert the patient when he or she is performing the undesired behavior. Typically the warning device causes the patient to experience an unpleasant sensation, thus promoting the discontinuance of the behavior. In one embodiment the system determines which stimuli is most effective and therefore best suited for an individual patient. The system may further include means to record the monitored data related to the undesired behavioral disorders. This feature allows the patient to receive data related to the rate, duration, intensity, and time of day that the unconscious behavior occurred thus allowing the patient to correlate the undesired behavior with outside factors.

According to the '158 patent, a variety of different sensor types may be used with the invention. For example, the sensor may monitor sounds (e.g., snoring, teeth grinding) emitted by the patient during the undesirable behavior. These sounds may be monitored with a microphone that detects the audible sounds, or with a microphone that detects sounds that are conducted by the patient's body tissues. Alternatively, the sensor may monitor changes in a group of muscles that are affected by the behavioral disorder. For example, muscles within the jaw and the temple contract during jaw clenching. Changes in a muscle group may be determined by monitoring such muscle properties as density, resiliency, electrical conductivity, electrical activity, elasticity, and thickness. In an alternative embodiment, a detector is mounted between the patient's teeth. The detector preferably comprises a bite guard or a pressure plate which is used to sense the force created by the act of the patient clenching or brushing his or her teeth.

U.S. Pat. No. 4,965,553, entitled "HAND-NEAR-MOUTH WARNING DEVICE," includes a wrist strap with a three-axis attitude sensor that senses when the wrist is in a position which places the hand near the wearer's mouth. An alarm is actuated by the three-axis sensor and warns the wearer that his hand is near his mouth. The device may therefore be used to warn either eaters or smokers that their hand is approaching their mouth and that they are about to engage in activity which they are attempting to limit. The apparatus is particularly suited for use with a calorie counter for counting calories consumed by the wearer during a given time period.

The term "three-axis" is used to describe any orthogonal three-axis system which describes the known three-dimensional spatial universe. Specifically, it is used to describe a sensor which is able to determine its three-dimensional angular orientation in relation to a gravitational field, such as the gravitational field acting upon the surface of the earth. Such a sensor is thought to useful because it will actuate, if properly adjusted, when the hand of a human, erect upon the surface of the earth, is brought near the human's mouth.

In a more sophisticated embodiment, the warning device is combined with a counter for counting calories (or cigarettes) consumed by the wearer. Such a counter would comprise a strap for wearing on the wrist, a memory for registering calories consumed, an entry means such a number pad for entering calorie intakes into the memory, a three-axis attitude sensor for sensing when the wrist is in a position to place food or a cigarette in the wearer's mouth, and an alarm for actuation by the three-axis sensor which would warn the wearer that the wrist is in a position to place food in the wearer's mouth.

The ability for a patient to predict when an undesirable behavior is about to occur should give that person the ability to refrain and prevent destructive events. While the device described in the '553 patent referenced above purports to monitor hand-near-mouth proximity, the solution appears to be technically unworkable and unnecessarily complex. The need therefore remains for a simple yet accurate system to more accurately predict and alert a patient to potentially impending destructive events associated with certain obsessive compulsive and habit disorders, including trichotillomania, onychophagia, thumb sucking, skin scratching, and other behavioral maladies involving self-inflicted harm. Moreover, such a device should optimally be utilized to assist a person with such a disorder in achieving an intentional, voluntary avoidance of the destructive behavior.

SUMMARY OF THE INVENTION

This invention broadly provides apparatus for discouraging certain types of obsessive compulsive spectrum and habit disorders such as trichotillomania, onychophagia, thumb sucking, skin scratching, and other forms of self-inflicted harm. The preferred embodiments incorporate a proximity detector including a sensor and an element associated with the arm, hand or finger of a user to be detected. The proximity detector is operative to generate an output signal in the event that the element has physically moved to within a predetermined distance relative to the sensor. The apparatus further includes a device operative to alert the user in response to the output signal generated by the proximity detector.

Either the sensor, the element to be detected, or both, may include electrically active or passive devices. To monitor thumb sucking and fingernail biting, the sensor may be disposed in a neckband, necklace, broach or other item proximate to the mouth of the user. For other disorders such as hair pulling and scratching, the sensor may be located wherever the condition exists. The element associated with the arm, hand or finger of a user to be detected may be a ring, bracelet, watch, watchband, skin patch, or other such item.

The proximity detector may be based on magnetism, capacitance, time-of-flight or any other mechanism capable of appropriate detection. The device operative to alert the user in response to the output signal generated by the proximity detector produces an audible, visual or tactile sensation, the latter including mild electrical shock. The sensor housing itself may produce the alert directly, or circuitry may be provided to produce a wireless signal to a separate unit operative to generate an audible, visual or tactile sensation. With appropriately miniaturized electronics, the entire sensor may be located solely on or in person's ear.

In the preferred embodiment, further circuitry is provided to measure the time during which the element is physically within the predetermined distance relative to the sensor so as to minimize false alarms. The system may also be equipped with a user-operable override preventing the alarm from being activated for a predetermined period of time to permit acceptable activities wherein the element has physically moved to within the predetermined distance relative to the sensor.

DETAILED DESCRIPTION OF THE INVENTION

Figure 1:
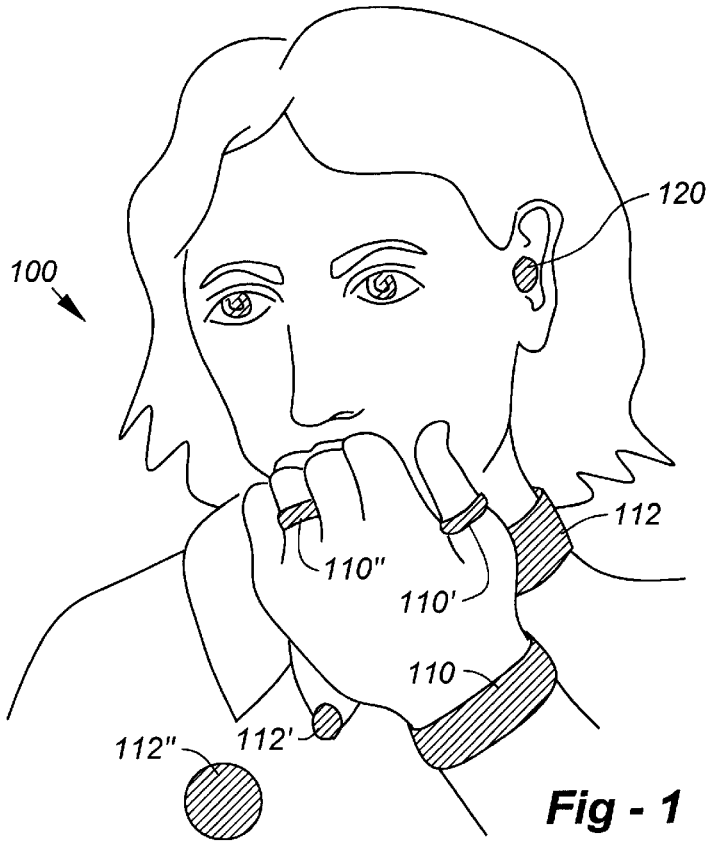
FIG. 1 is a drawing of an individual equipped with apparatus according to this invention.

Now making reference to the drawings, FIG. 1 is an illustration of an individual depicted generally at 100 in conjunction with different physical placement embodiments according to the invention. In a preferred arrangement, a proximity detector including some form of sensor is used to detect an element and activate an alarm or otherwise make the individual aware that they are engaging in a behavior to be modified.

With respect to thumb-sucking and nail-biting in particular, a sensor is preferably located near the mouth of the individual, with an element to be detected being located on or near the hand. For example, as shown in FIG. 1, a sensor may be located on a neckband 112 or, alternatively, necklace 112', broach 112", or any other location operatively feasible. The element to be detected in this case may include a wristband 110 or, alternatively, thumb ring 110', finger ring 110", and so forth.

As discussed below, the invention is not limited in terms of the proximity detection scheme utilized. However, for practical reasons, it is desirable to have the larger and/or electrically active portion of the proximity detector being contained in the most discrete manner, while also enabling multiple elements to be detected, for example, in the case that an individual sucks both thumbs or chews on the nails of both hands. Thus, for example, the neckband 112, necklace 112' or broach 112" may be battery-operated and capable of detecting an electrically passive wristband or ring, thereby enabling multiple such elements to be used without replicating more expensive electronic circuitry. Nevertheless, the "active" portion of the circuit may also be located on the hand/limb to be detected, as the invention is not limited in this regard.

Although, in FIG. 1, the sensors and items to be detected are associated with the head and an extremity such as the hand, in the case of skin-scratching, it may not be the mouth area of the individual to be monitored, but rather, the back of the head or other portions of the scalp, the legs, and so forth. In such cases, while the element to detect would still be located on the hand(s), the sensor portion may be located at the back of the head on a neckband, in some form of head gear, on the legs, and so forth, depending upon the behavior to be controlled.

Figure 2:
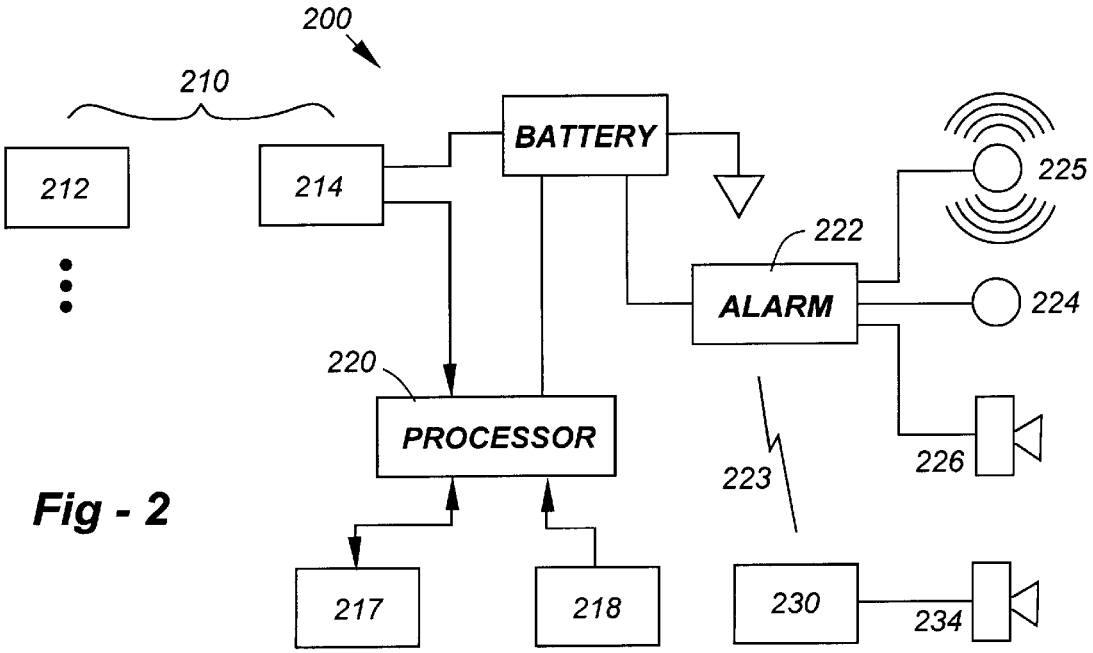
FIG. 2 is a simplified block diagram of electronic circuitry applicable to the invention.

As discussed in more detail with respect to the block diagram of FIG. 2, the sensor portion includes some form of alarm or other type of signaling device to alert the individual 100 that they are engaging in an unwanted behavior. While the sensor portion itself (i.e., the neckband, necklace or broach) may include an audible alarm, or the like, it is also anticipated by the invention that a wireless link may be included to an alarm elsewhere on the body, such as a device 120 located in the ear. With appropriately miniaturized electronics, the entire sensor may be located solely on or in person's ear. Just as the invention is not limited in terms of the proximity detection scheme utilized, the invention is not limited in terms of the type of alarm used, and may include visible, audible, or tactile/vibrational transducers and mild shock generators, as appropriate.

Now making specific reference to the block diagram of FIG. 2, the proximity detector is shown generally at 210, involving a sensor aspect 214 in conjunction with one or more elements 212 to be detected. The signal from the sensor aspect 214 is received by a processor 220 or other type of electronic circuitry, driving an alarm circuit 222 which, as discussed above, may directly drive an audible alert 226, visual alert 224 or vibrational alert 225. As an option, or in conjunction with such mechanisms, a wireless signal 223 may be delivered to a remote alarm 230 also capable of driving an audible alert 234 or other type of visual/tactile alert (not shown). The wireless signal 223 may be of any form, including electromagnetic, optical or acoustic/ultrasonic of the type used by announcers, and the like which make use of passive ear-receiving devices.

The circuitry shown generally at 200 further includes a counter/delay block 217 to ensure against false alarms. This is important, since the hands of an individual are often brought up to the mouth or face for legitimate purposes, such as eating, coughing, toothbrushing, and so forth. Accordingly, the counter/delay circuitry 217 informs the processor 220 that short-lived detections utilizing the arrangement 210 may, in fact, be legitimate, such that longer-length or more consistent triggers should be used instead to activate the alarm circuit 222. Preferably the counter/delay circuitry 217 is adjustable, either by the user or a physician, as the case may be.

The circuitry shown generally at 200 further preferably includes some form of user control such as on/off, adjust/override circuit 218. Not only does this interface allow a user to turn the active portion on and off on a permanent basis, in the preferred embodiment, an override may be used should the person be engaging in a legitimate activity such as eating, coughing, toothbrushing, and so forth. In this particular instance, a button would be pressed, disabling the circuit from triggering for a predetermined (though adjustable) period of time, such as five minutes or thereabouts, after which the system would automatically become active and begin searching to detect undesirable behaviors.

In terms of sensors, as discussed above, the invention may utilize any form of proximity detection scheme, though in the preferred embodiment, a low-cost yet reliable system would be used, while enabling the element to be detected to be passive, enabling such element to assume the form of a ring, bracelet, or other discrete type of housing. Nevertheless, the invention may utilize capacitive sensing; electric-field sensing; various forms of magnetic sensing including inductive, Hall-effect, reed-switch and Eddy-current varieties; magneto-resistive approaches; optical/infrared; color/pattern recognition; ultrasonic; acoustic emission; radar; sonar; and approaches based upon conductive/resistance phenomena.

In the preferred embodiment, however, a magnetic or ultrasonic time-of-flight approach is used due to a desirable tradeoff between cost and acceptable range of detection. In terms of a magnetic solution, a magnetic-field sensor may be used. Such devices, available from companies including Philips, Honeywell, and others, are low in cost and sensitive in 1 to 3 dimensions, depending upon the component. A reed-switch sensor may alternatively be used, or a search-coil technique, which would detect the presence of various metals in addition to magnets and magnetizable materials. Various other magnetic and electromagnetic induction detection methodologies are also applicable.

Ultrasonic proximity detectors use time-of-flight principles to measure distances measurable in inches, and are therefore also well-suited to the invention. An ultrasonic proximity detector operates by transmitting inaudible pulses, which are then measured and compared to the length of time that it takes the pulses to strike an object and return as an echo. The longer the time, the farther away the object. In this case, then, processor 220 would include appropriate circuitry to perform the counting and distance computation functions with the blocks 212 and 214 being responsible for the sending and detecting of the ultrasonic pulses. In all embodiments, a control is preferably provided to set a threshold related to distance to ensure accurate, repeatable results.

I claim:

1. Apparatus for discouraging certain types of obsessive compulsive and habit disorders including trichotillomania, onychophagia, thumb sucking, and skin scratching, comprising:

a proximity detector including a sensor disposed in a neckband, necklace, broach or other item proximate to the mouth of a user;

an element associated with the user's arm;

the proximity detector being operative to generate an output signal in the event that the element has physically moved to within a predetermined distance relative to the sensor; and a device operative to alert the user in response to the output signal generated by the proximity detector.

2. The apparatus of claim 1, wherein the sensor is electrically activated and the element to be detected is electrically passive.

3. The apparatus of claim 1, wherein the proximity detector is based on magnetism.

4. The apparatus of claim 1, wherein the proximity detector is based on the time-of-flight of a wireless signal communicating between the sensor and the element to be detected.

5. The apparatus of claim 1, wherein the device operative to alert the user in response to the output signal generated by the proximity detector produces an audible, visual or tactile sensation.

6. The apparatus of claim 1, wherein the device operative to alert the user in response to the output signal generated by the proximity detector produces a wireless signal to a separate unit operative to generate an audible, visual or tactile sensation.

7. The apparatus of claim 1, further including circuitry operative to measure the time during which the element is physically within the predetermined distance relative to the sensor so as to minimize false alarms.

8. The apparatus of claim 1, further including a user-operable override preventing the alarm from being activated for a predetermined period of time to permit acceptable activities wherein the element has physically moved to within the predetermined distance relative to the sensor.

9. Apparatus for discouraging certain types of obsessive compulsive and habit disorders including trichotillomania, onychophagia, thumb sucking, and skin scratching, comprising:

a body-worn housing including a proximity sensor;

an element worn on the arm, hand or finger of a user which is detectable by the proximity sensor;

battery-operated circuitry within the housing operative to generate an alarm signal in the event that the element has physically moved to within a predetermined distance relative to the sensor; and a device operative to alert the user in response to the alarm signal generated by the battery-operated circuitry within the housing.

10. The apparatus of claim 9, wherein the housing is in the form of a neckband, necklace or broach.

11. The apparatus of claim 9, wherein the element worn on the arm, hand or finger is magnetic.

12. The apparatus of claim 9, wherein:

the element worn on the arm, hand or finger includes a transponder operative to receive a wireless signal from the housing and return a wireless signal to the housing; and circuitry operate to measure the distance between the sensor and the element to be detected in accordance with time-of-flight principles.

13. The apparatus of claim 9, wherein the device operative to alert the user in response to the alarm signal produces an audible, visual or tactile sensation.

14. The apparatus of claim 9, wherein the device operative to alert the user in response to the alarm signal produces a wireless signal to a separate unit operative to generate an audible, visual or tactile sensation.

15. The apparatus of claim 9, further including circuitry operative to measure the time during which the element is physically within the predetermined distance relative to the sensor so as to minimize false alarms.

16. The apparatus of claim 9, further including a user-operable override preventing the alarm from being activated for a predetermined period of time to permit acceptable activities wherein the element has physically moved to within the predetermined distance relative to the sensor.

17. The apparatus of claim 9, wherein the element worn on the arm, hand or finger is a ring.

18. The apparatus of claim 9, wherein the element worn on the arm, hand or finger is a bracelet.

19. The apparatus of claim 9, wherein the element worn on the arm, hand or finger is a watch or watchband.

* * * * *